US010381183B2

(12) United States Patent
Sweeney

(10) Patent No.: US 10,381,183 B2
(45) Date of Patent: Aug. 13, 2019

(54) POWER DISTRIBUTION CLIP ASSEMBLY

(71) Applicant: Ilsco Corporation, Cincinnati, OH (US)

(72) Inventor: Thomas M. Sweeney, Cincinnati, OH (US)

(73) Assignee: Ilsco Corporation, Cincinnati, OH (US)

( * ) Notice: Subject to any disclaimer, the term of this patent is extended or adjusted under 35 U.S.C. 154(b) by 0 days.

(21) Appl. No.: 15/812,197

(22) Filed: Nov. 14, 2017

(65) Prior Publication Data

US 2018/0144899 A1 May 24, 2018

Related U.S. Application Data

(60) Provisional application No. 62/425,113, filed on Nov. 22, 2016.

(51) Int. Cl.

| | |
|---|---|
| ***H01H 85/20*** | (2006.01) |
| ***H01R 4/48*** | (2006.01) |
| ***H01R 9/18*** | (2006.01) |
| ***H01R 4/30*** | (2006.01) |
| ***H01R 4/36*** | (2006.01) |
| ***H01R 9/24*** | (2006.01) |

(52) U.S. Cl.

CPC ..... *H01H 85/203* (2013.01); *H01H 85/202* (2013.01); *H01R 4/308* (2013.01); *H01R 4/36* (2013.01); *H01R 4/48* (2013.01); *H01R 9/18* (2013.01); *H01R 9/2416* (2013.01); *H01H 2085/206* (2013.01); *H01H 2085/2055* (2013.01); *H01R 9/245* (2013.01)

(58) Field of Classification Search

CPC .. H01H 85/153; H01H 85/157; H01H 85/202; H01H 85/203; H01H 85/205; H01H 2085/2055; H01H 2085/206; H01R 4/48; H01R 9/2416; H01R 4/308; H01R 4/36; H01R 9/18; H01R 9/245

USPC ..... 337/190

See application file for complete search history.

(56) References Cited

U.S. PATENT DOCUMENTS

| | | | | |
|---|---|---|---|---|
| 2,041,613 A * | 5/1936 | Lincks | H01H 1/5855 | 24/569 |
| 3,131,984 A * | 5/1964 | Kobryner | H01R 27/00 | 337/195 |
| 3,335,399 A * | 8/1967 | Rys | H01H 1/5855 | 439/739 |
| 4,050,045 A | 9/1977 | Motten, Jr. et al. | | |
| 4,059,334 A | 11/1977 | Bailey | | |

(Continued)

FOREIGN PATENT DOCUMENTS

GB 460958 A 2/1937

*Primary Examiner* — Jacob R Crum

(74) *Attorney, Agent, or Firm* — Wood Herron & Evans LLP

(57) ABSTRACT

A power distribution assembly which may be a fuse clip or a switch includes a lug mounted to a block in association with a spring clip which confronts one side of the lug. A portion of the spring clip is mounted to the block and an upper spring arm of the clip is positioned on one side of the lug. The lug is mounted to the block and includes a downwardly projecting tang which is inserted through a slot in the bottom portion of the assembly to thereby couple the spring arm to the lug and block and to receive the end of the fuse or a blade between the spring arm and the lug.

23 Claims, 6 Drawing Sheets

(56) References Cited

U.S. PATENT DOCUMENTS

| | | | | |
|---|---|---|---|---|
| 4,201,439 | A * | 5/1980 | M'Sadoques | H01R 13/113 439/839 |
| 4,472,018 | A * | 9/1984 | Urani | H01H 85/205 439/814 |
| 4,500,162 | A | 2/1985 | Keglewitsch et al. | |
| 5,118,314 | A | 6/1992 | Mangone et al. | |
| 7,234,968 | B2 | 6/2007 | Lottmann et al. | |
| 7,503,800 | B2 * | 3/2009 | Siglock | H01R 4/36 439/517 |
| 8,193,459 | B2 | 6/2012 | Abroy | |
| 8,702,455 | B1 | 4/2014 | Lackey et al. | |
| 8,764,494 | B2 | 7/2014 | Joseph et al. | |
| 9,368,296 | B2 | 6/2016 | Holland et al. | |

* cited by examiner

POWER DISTRIBUTION CLIP ASSEMBLY

This claims the benefit of U.S. Provisional Patent Application Ser. No. 62/425,113, filed Nov. 22, 2016 and hereby incorporated by reference in its entirety.

BACKGROUND OF THE INVENTION

This invention relates generally to power circuit distribution devices, and more particularly to fuseholders for connecting overcurrent protection fuses to electrical circuitry.

Electrical systems typically include of circuit protection devices that protect electrical circuitry, equipment, and components from damage. Overcurrent protection devices, for example, are constructed to physically open or interrupt a circuit path and isolate electrical components from damage upon the occurrence of specified overcurrent conditions in the circuit. Known circuit protection devices include devices such as fuses, circuit breakers, and limiters, which may address overcurrent, overload, and short circuit conditions in an electrical system, and other switching devices.

Typically, circuit protection devices, such as fuses, are connected to electrical circuitry using a combination of terminal blocks, sometimes referred to as power distribution blocks, lugs and fuseholders. The terminal blocks provide for electrical connection to power receiving devices, sometimes referred to as loads, while the fuseholders provide for connection of the fuses to power supply devices. The fuseholders are commonly wired to the terminal blocks to provide fused protection of the load side electrical connections, circuitry, and associated devices.

Fuse clips are widely used to connect fuses into electrical circuits. Blade-type cartridge fuses are particularly used in power circuits or the like. The blade-type fuse includes a cartridge body with connecting contact blades at each of the opposite ends of the body. The fuse blade provides a large extended contact surface for current transfer to the connected circuit. Generally, blade-type fuse clips have included a pair of opposing spring contact members which resiliently grasps the opposite surfaces of the fuse blade. More recently, single surface terminal blocks have been suggested having a flat wall against which the fuse blade is resiliently held by a spring member.

Although the various fuse clip devices have found wide application and usage in the industry, a relatively large insertion force is normally encountered to produce the desired holding force. Relatively complex designs have been used in connection with the fuse clip assemblies employing a substantial number of different components. Prior art devices have also generally not been conducive to small, compact construction while maintaining the necessary electrical characteristic, and in many cases, have been relatively costly to construct. Similar considerations also apply in other types of fuses.

SUMMARY OF THE INVENTION

These and other problems in the prior art have been addressed in various embodiments of this invention in which a power distribution assembly which may be a fuse clip assembly or a switch and includes a lug mounted to a block in association with a spring clip which confronts one side of the lug. A bottom portion of the spring clip is mounted to the block and an upper spring arm portion of the clip is positioned on one side of the lug. The lug is mounted to the block and in one embodiment includes a downwardly projecting tang which is inserted through a slot in the bottom portion of the spring clip.

The fuse clip assembly of this invention is intended to receive the flat blade extension on a fuse between the spring arm and the side of the lug. Other embodiments of the spring clip assembly accept a barrel type fuse. Two adjacent and spaced fuse clips may be positioned to receive the opposed and longitudinally extending blades or barrel ends of the fuse. The lug receives the end of one or more conductors for connection to the fuse clip assembly. Other embodiments of this invention are directed to a switch with a number of blades, each selectively connected to a lug and an associated spring clip.

The invention is further directed to a fuse clip assembly including an extruded lug functioning as, both, a terminal connector and a fuse blade contact surface, and a resilient spring arm mounted to the lug for maintaining a fuse blade in surface contact with the lug.

As such, the power distribution assembly of various embodiments of this invention provides a simple, effective and reliable connection to a fuse or a blade switch without the problems associated with prior art devices. The simplicity of the apparatus, with the reduction in component parts not only reduces the cost but contributes to a simplified manufacturing technique for a contact structure, which has particularly provided an improved fuse clip apparatus having a high degree of integrity, quality, performance and fatigue strength.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
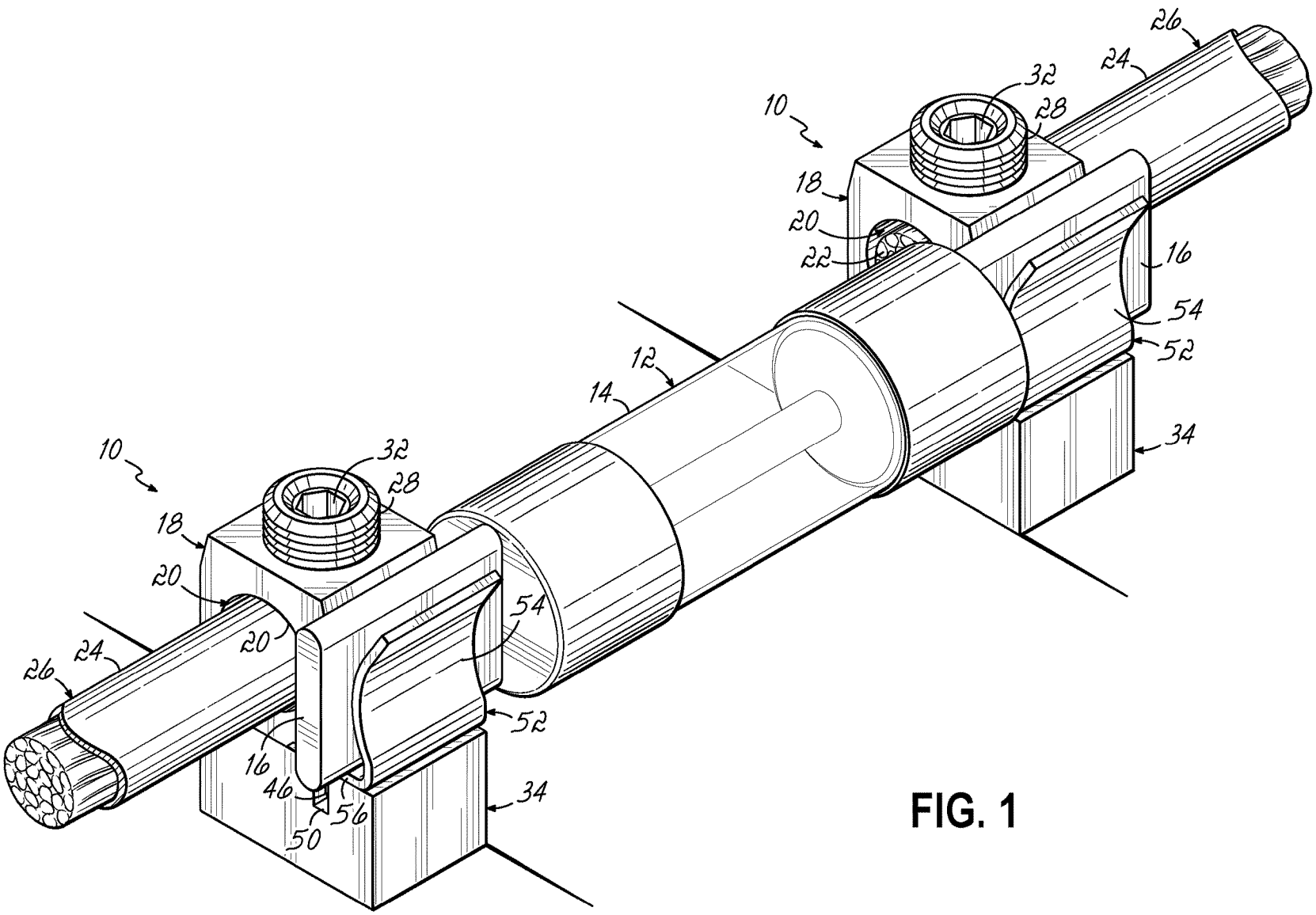
FIG. 1 is a perspective view of one embodiment of a fuse clip assembly for power distribution according to this invention.

Referring to FIG. 1, one embodiment of a power distribution fuse clip assembly 10 according to this invention is shown. The assembly 10 of FIG. 1 is utilized to mount a standard blade or barrel type fuse 12. The fuse 12 includes a fuse body 14 with opposing contact ends which in one form are blades 16 extending longitudinally from the fuse body 14. The blades 16 are generally planar and adapted to mount into one of two fuse clip assemblies 10 according to various embodiments of this invention.

Figure 2:
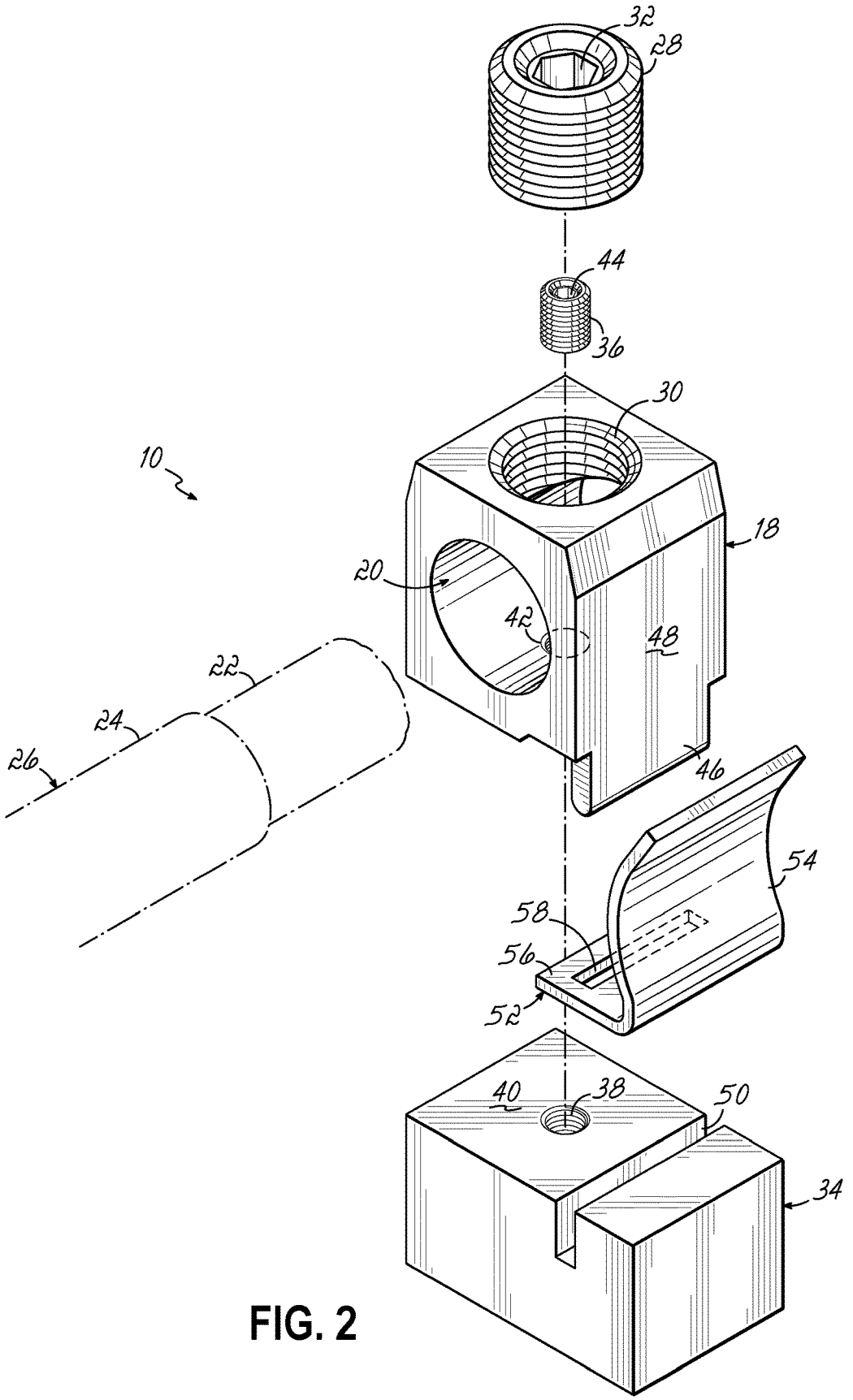
FIG. 2 is an exploded view of the fuse clip assembly of the embodiment of FIG. 1.
Figure 3:
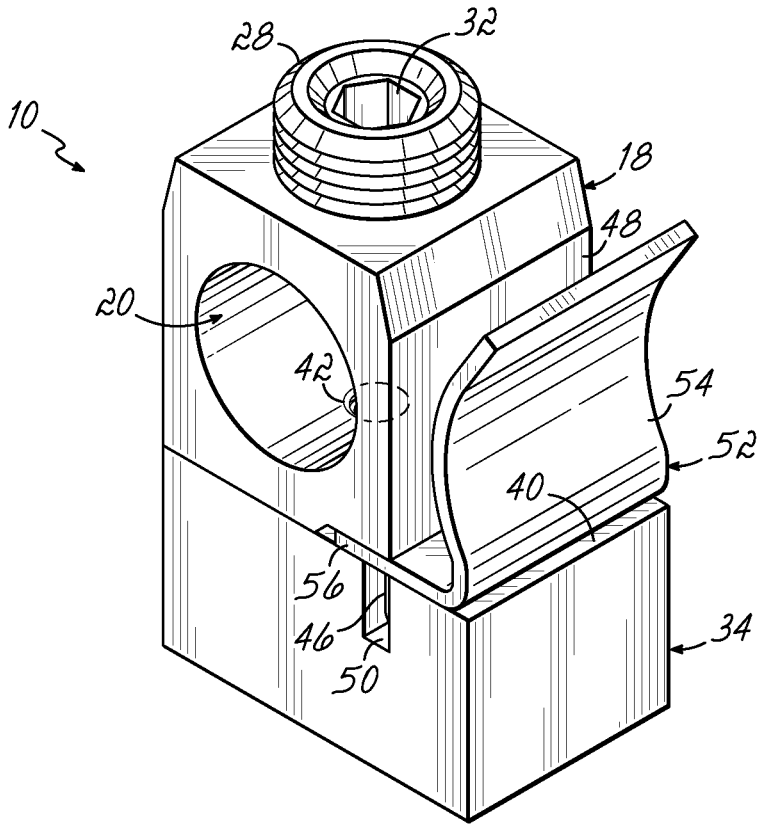
FIG. 3 is an assembled perspective view of the components of FIG. 2.
Figure 4:
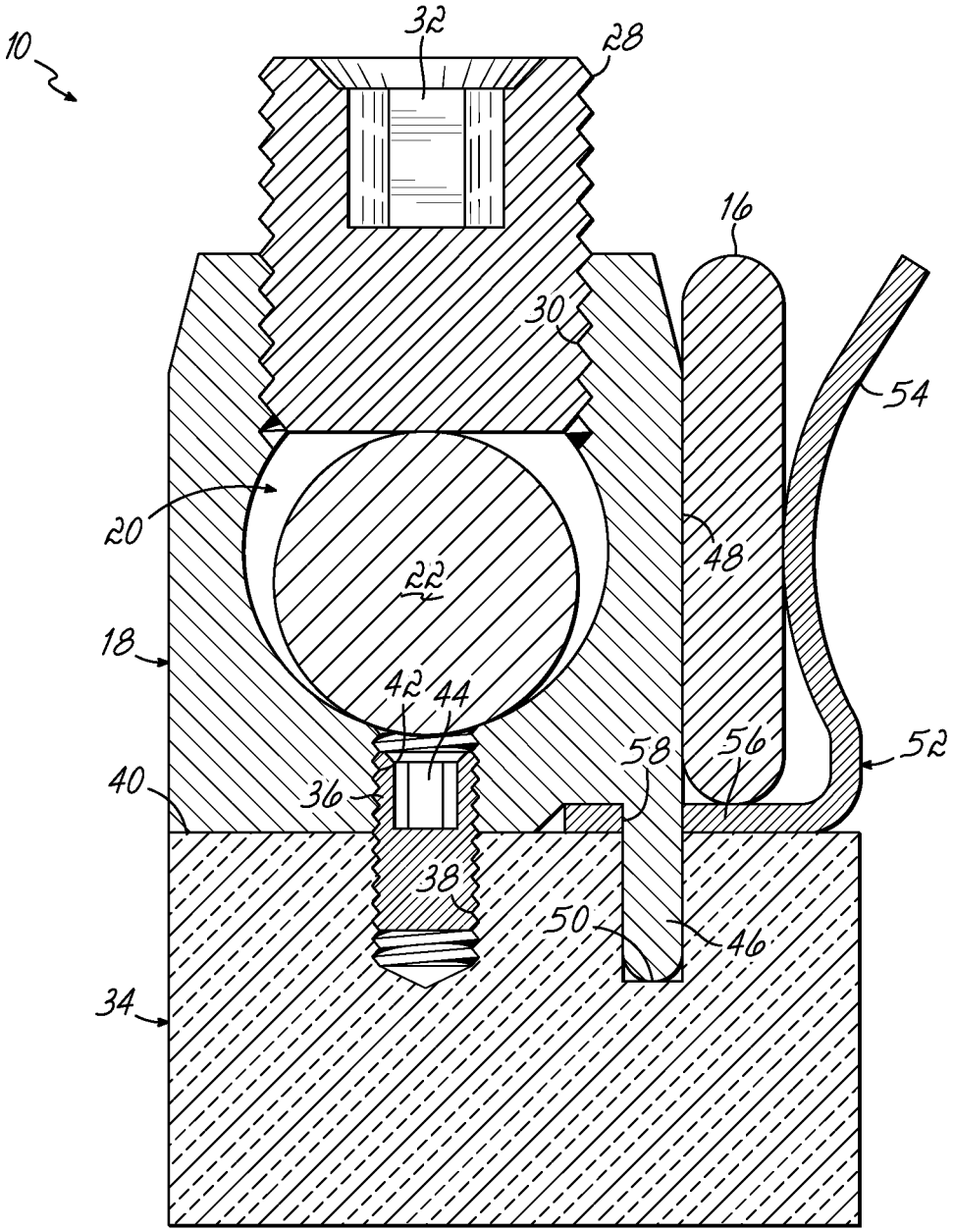
FIG. 4 is a cross-sectional view of the assembly of FIG. 3.

Referring more particularly to FIGS. 2-4, the fuse clip assembly 10 according to embodiments of this invention includes a lug 18 which has a conductor receiving arrangement which in one embodiment is a port 20 to receive the exposed strands of wire 22 projecting from a sheath 24 of the conductor 26. Once the wire strands 22 are inserted into the conductor port 20, a conductor retainer which in one embodiment is a set screw 28 is received within a set screw threaded aperture 30 of the lug 18 to releasably secure the conductor 26 to the lug 18. The set screw 28 may include a feature such as a shaped socket 32 for receiving a tool such as an Allen wrench to advance and retract the set screw 28 in the set screw aperture 30 of the lug 18.

The lug 18 is secured to a mount, which in one embodiment is a block 34, via a retainer which in one embodiment is a mounting screw 36. The block 34 includes a threaded aperture 38 on an upper face 40 thereof. A mounting screw aperture 42 is provided in the lug 18 and in communication with the conductor port 20 as shown most clearly in FIG. 4. Prior to inserting the conductor 26 and set screw 28 in the lug 18, the lug 18 is mounted on the block 34 and secured thereto via the mounting screw 36 which is threadably received in the mounting screw aperture 42 in the bottom of the lug 18 and the complimentary threaded aperture 38 in the confronting face 40 of the block 34 as shown in FIG. 4. A shaped socket 44 is provided in the top of the mounting screw 36 to receive therein a tool such as an Allen wrench for fastening and loosening the mounting screw 36 within the lug 18 and the block 34. In an alternative embodiment, the lug 18 may be mounted to the block 34 via the mounting screw 36 which extends upwardly through the aperture 38 in the block 34 and into the mounting screw aperture 42 in the lug 18. In this embodiment, the mounting screw aperture 42 is threaded to mate with threads on the mounting screw 36. The mounting screw 36 may have a head which is retained in the block 34 with the threaded shaft projecting into the lug 18.

The lug 18 includes a downwardly extending projection which in one embodiment is a tang 46 on one face 48 of the lug 18 as shown most clearly in FIG. 2. The tang 46 is sized and positioned to be received within a seat, which in one embodiment is a channel 50 on the upper face 40 of the block 34 as shown most clearly in FIG. 4.

Another component of the fuse clip assembly 10 according to embodiments of this invention is a spring clip 52 which includes an upper spring clip arm 54 and a lower base 56. The lower base 56 in various embodiments is a generally planar extension from a lower edge of the spring arm 54. The base 56 includes an aperture or slot 58 sized and dimensioned to receive there through the tang 46 of the lug 18 as shown more particularly in FIG. 4. The shape and configuration of the slot 58 and tang 46 which is received in the channel 50 of the block 34 prevents pivotal relative movement and rotation of the lug 18 and spring clip 52 relative to the block 34 when the components are assembled.

The spring arm 54 of the fuse clip assembly 10 is bowed inwardly towards the face 48 of the lug 18 as shown particularly in FIG. 4. The spring arm 54 when mounted in the assembly is capable 10 of flexing toward and away from the face 48 of the lug 18. The dimensions and design of the spring arm 54 securely retain the blade 16 of the fuse 12 against the face 48 of the lug 18. One advantage of this invention is the intimate face-to-face contact of substantially the entire face of the blade 16 with substantially the entre face 48 of the lug 18 providing electrical continuity between the components while releasably retaining the blade 16 and associated fuse 12 in the assembly 10.

Figure 5A:
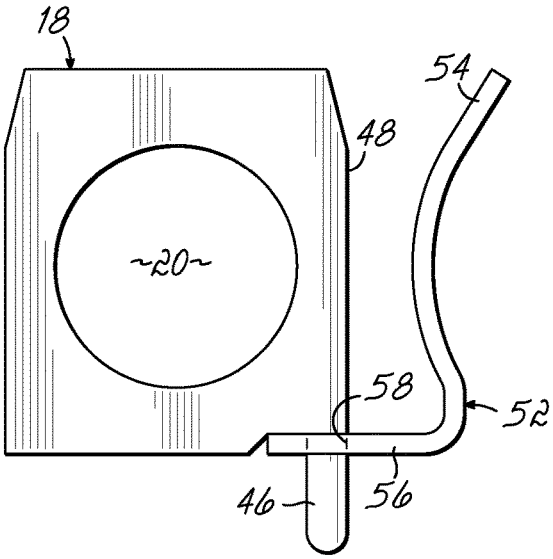
FIGS. 5A-5D are each a side elevational view of an alternative embodiment of a lug of a power distribution assembly of this invention.
Figure 5B:
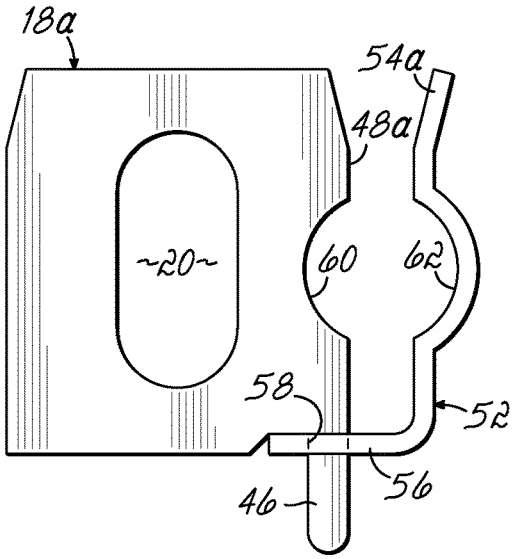
Figure 5C:
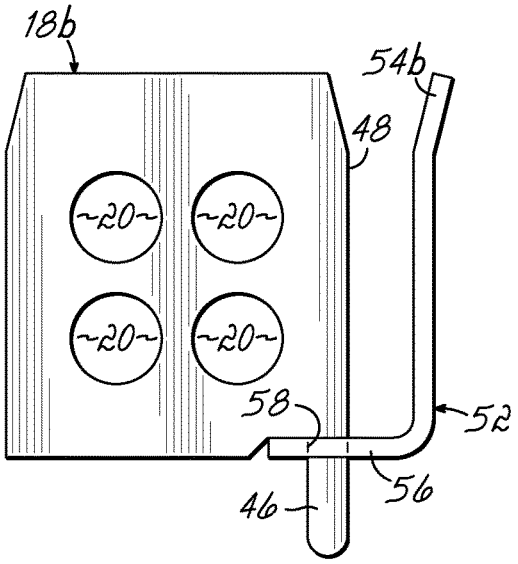
Figure 5D:
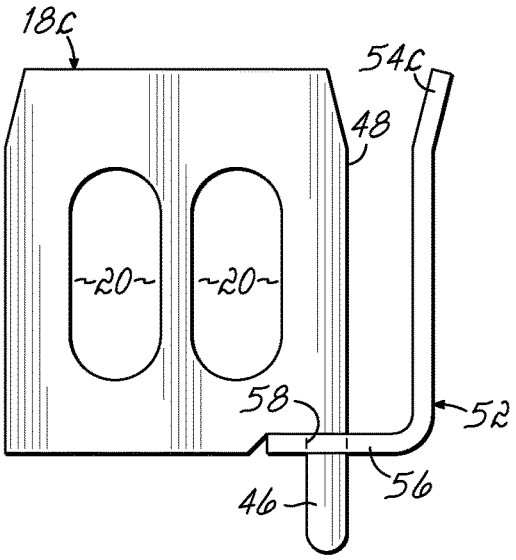

FIGS. 5A-5D show alternate embodiments of the lug 18, 18*a*, 18*b*, 18*c* and spring arm 54, 54*a*, 54*b*, 54*c* components according to this invention. FIGS. 5C and 5D provide multiple conductor ports 20 in the lug 18*b*, 18*c* for multiple conductors 26 to be secured to the lug 18*b*, 18*c*. FIG. 5B allows for a barrel or cartridge-type fuse (not shown) to be secured to the assembly 10. The face of the lug 48*a* includes a groove 60 and the spring arm 54*a* includes a divot 62 each sized and configured to securely retain the end of a barrel or cartridge-shaped fuse such as that shown in U.S. Pat. No. 3,275,772, hereby incorporated by reference, and well known in the art. The upper spring arm 54*b*, 54*c* of the spring clip of the embodiments shown in FIGS. 5C and 5D do not include the bowed or arcuate configuration of the spring arm 54*b*, 54*c* as shown in FIGS. 4 and 5A thereby providing more intimate contact to the adjacent face of the blade 16 of the fuse 12 with these embodiments. One of ordinary skill in the art will appreciate that other configurations of the lug and spring arm components are well within the scope of this invention. Moreover, grease or other compounds may be utilized for the safe, efficient and clean insertion and removal of the blades and barrel fuse cartridges into the assembly as is appropriate.

Moreover, while the spring clip 52 according to various embodiments of this invention is a metallic component, the objectives of securely mating the fuse with the lug can readily be obtained through other materials while providing the resilience and biasing force to seat the blade or end of the fuse against the lug 18 within the scope of this invention.

The fuse clip assembly 10 therefore combines the function of a conventional fuseholder with the function of a conventional terminal block, and eliminates the need for conventional terminal blocks or power distribution blocks. Costs associated with obtaining and installing terminal blocks may be saved, and separate wiring of the terminal block may be eliminated. Fused protection may therefore be provided at lower cost with a faster installation time than has conventionally been possible.

Figure 6:
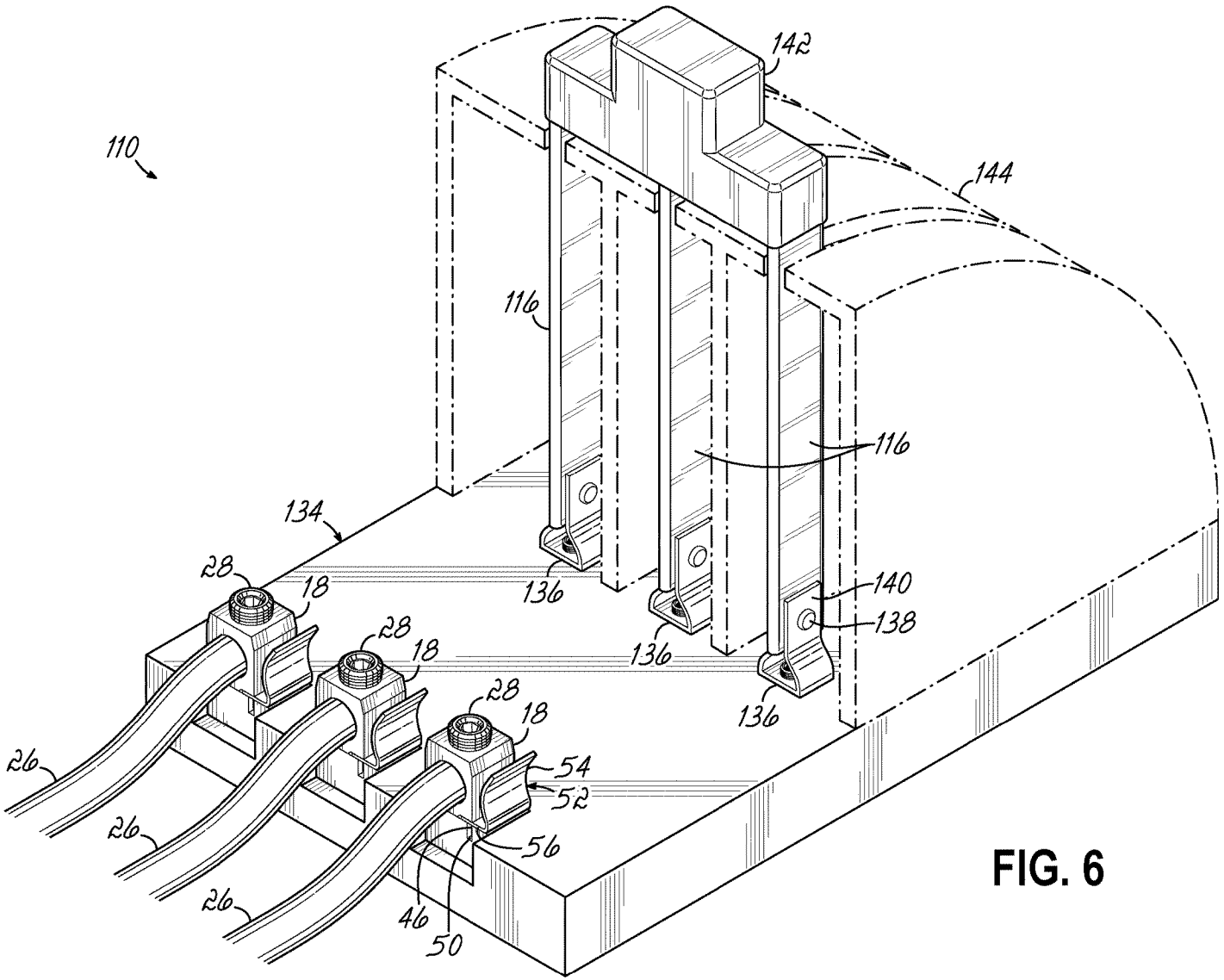
FIG. 6 is a perspective view of another embodiment of this invention in the form of a blade switch.

In FIG. 6 another embodiment of this invention is shown as applied to an electrical blade switch 110 in which a number of conductors 26 are connected to the switch 110 via an equal number of lugs 18. Each lug 18 has a set screw 28 for selectively securing the associated conductor 26 to the lug 18. Each lug 18 is mounted to a block 134 as in the embodiments of this invention shown in FIGS. 1-5D. Each lug 18 likewise has a downwardly projecting tang 46 seated within a channel 50 in the block 134. Similarly, each lug 18 has a spring clip 52 with a clip arm 54 juxtaposed to a face 48 of the lug and a lower base 56 with a slot 58 through which the tang 46 of the associated lug 18 projects as in the embodiments of FIGS. 1-4.

The switch 110 of FIG. 6 also includes a number blades 116 each pivotally mounted to the block 134 via a respective bracket 136. Each blade 116 is mounted to one of the brackets 136 via a pin 138 extending through an upper flange 140 of the bracket 136 and the blade 116 to allow for pivotal movement of the blade 116 relative to the block 134 toward and away from the associated lug 18. A grip 142 is mounted collectively to all of the blades 116 at an end opposite from the bracket 136 so that a user may collectively pivot the blades 116 into and out of engagement with the lugs 18. Each blade 116 is captured between the associated spring clip arm 54 and respective lug 18 to thereby close the switch 110 and provide for electrical connection with the conductors 26 when the switch 110 is in the closed position (not shown). Alternatively, the user may grasp the grip 142 and pivot the blades 116 upwardly away from the lugs 18 to place the switch no in the open position and interrupt the electrical connection with the conductors 26 as shown in FIG. 6. A cover 144 may be provided on the block 134 to shield the blades 116, brackets 136 and lugs 18 in various embodiments of the switch no of this invention.

Any of the components described herein can be composed of a conductive material, including aluminum, copper, or alloys thereof. Specifically, any of the spring clips 52 described herein can be composed of a material that includes copper, such as spring copper which, when bent, can return to its original position. An example of a suitable copper includes 151 Cu or 155 Cu. Moreover, the spring clip 52 of this invention may be a non-conductive, non-metallic or other material while providing the requisite spring force for contact between the fuse 12 and the lug 18.

This invention thus provides a simple, reliable and improved blade-type contact arrangement and has particularly been applied in a fuse clip assembly 10 and a switch no having a significant improvement in the spring characteristic, with a minimal insertion force. The various embodiments each include a short current path between the fuse or blade and the circuit leads as a result of the one full side contact of the lug 18. The minimum components required by the invention results in improvement in the integrity, the quality and the fatigue strength associated with the fuse clip apparatus. The design is of course universally applicable to all blade-type fuse assemblies as well as other fuses and may be relatively small and compact in design.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A power distribution assembly comprising:
a lug having a first face and a second face;
a conductor receiving arrangement on the first face of the lug adapted to receive a conductor for electrical connection with the lug;
a projection integral with and extending from the lug;
a mount on which the lug is positioned;
a clip having a clip arm and a base;
an aperture in the base of the clip;
a seat on the mount;
wherein the projection extending from the lug extends through the aperture of the base of the clip and into the seat on the mount;
the clip arm being juxtaposed to the second face of the lug and adapted to retain a power distribution component therebetween in direct contact and electrical connection with the second face of the lug;
wherein the conductor receiving arrangement is a port in the first face of the lug and in communication with a set screw aperture in another face of the lug; and
a set screw threadably received in the set screw aperture to engage and secure the conductor to the lug and being accessible when the power distribution component is retained by the clip arm.

2. The assembly of claim 1 wherein at least a portion of the base of the clip is positioned between the lug and the mount.

3. The assembly of claim 1 wherein the projection on the lug is a downwardly extending tang having a generally rectangular cross-section.

4. The assembly of claim 3 wherein the seat on the mount is a channel having a size and configuration to receive therein the tang.

5. The assembly of claim 4 wherein the aperture in the base of the clip is a slot having a size and configuration to receive therethrough the tang.

6. The assembly of claim 1 where in the power distribution component is a fuse having an end feature and the end feature is releasably retained between the clip arm and the second face of the lug.

7. The assembly of claim 6 wherein the end feature is one of a blade and an end cap.

8. The assembly of claim 1 wherein the clip arm is a spring arm capable of deflection toward and away from the second face of the lug.

9. The assembly of claim 1 further comprising:
a mounting screw securing the lug to the mount.

10. The assembly of claim 1 further comprising:
a plurality of the conductor receiving ports in the first face of the lug each adapted to receive one of a plurality of conductors for electrical connection to the lug.

11. The assembly of claim 1 wherein the projection extending through the aperture of the base clip and into the seat of the mount inhibits rotation of the lug and the clip relative to the mount.

12. A power distribution assembly comprising:
a lug having a first face and a second face;
a conductor receiving arrangement on the first face of the lug adapted to receive a conductor for electrical connection with the lug;
a projection integral with and extending from the lug;
a mount on which the lug is positioned;
a clip having a clip arm and a base;
an aperture in the base of the clip; and
a seat on the mount;
wherein the projection extending from the lug extends through the aperture of the base of the clip and into the seat on the mount;
the clip arm being juxtaposed to the second face of the lug and adapted to retain a power distribution component therebetween and in electrical connection with the lug;
wherein the power distribution component is a fuse having an end feature in the form of a blade and the clip arm retains the blade against the second face of the lug with generally planar face to face contact therebetween;
wherein the conductor receiving arrangement is a port in the first face of the lug and in communication with a set screw aperture in another face of the lug; and
a set screw threadably received in the set screw aperture to engage and secure the conductor to the lug and being accessible when the power distribution component is retained by the clip arm.

13. The assembly of claim 1 wherein the power distribution assembly is one of a fuse clip assembly and a switch.

14. A fuse clip assembly for connection with a fuse having an end feature, the assembly comprising:
a lug having a first face and a second face;
a conductor port on the first face of the lug adapted to receive a conductor for electrical connection with the lug;
a tang having a generally rectangular cross-sectional configuration and being integral with and extending downwardly from the lug;
a mount on which the lug is positioned;
a clip having a spring clip arm and a base, wherein at least a portion of the base of the clip is positioned between the lug and the mount, wherein the spring clip arm is spaced from and capable of deflection toward and away from the second face of the lug;
a slot in the base of the clip;

a channel on the mount;

wherein the tang extending from the lug extends through the slot of the base of the clip and into the channel on the mount;

wherein the tang extending through the slot of the base clip and into the channel of the mount inhibits rotation of the lug and the clip relative to the mount;

the clip arm being juxtaposed to the second face of the lug and adapted to retain the end feature of the fuse therebetween in direct contact and electrical connection with the second face of the lug;

wherein the conductor port on the first face of the lug is in communication with a set screw aperture in another face of the lug; and a set screw threadably received in the set screw aperture to engage and secure the conductor to the lug and being accessible when the fuse is retained by the clip arm.

15. The assembly of claim 14 wherein the end feature is one of a blade and an end cap.

16. The assembly of claim 14 wherein a mounting screw is axially aligned with the set screw aperture and the set screw threadably received therein, the mounting screw securing the lug to the mount.

17. The assembly of claim 14 further comprising:

a plurality of the conductor receiving apertures in the first face of the lug each adapted to receive one of a plurality of conductors for electrical connection to the lug.

18. A fuse clip assembly for connection with a fuse having an end feature, the assembly comprising:

a lug having a first face and a second face;

a conductor port on the first face of the lug adapted to receive a conductor for electrical connection with the lug;

a tang having a generally rectangular cross-sectional configuration and being integral with and extending downwardly from the lug;

a mount on which the lug is positioned;

a clip having a spring clip arm and a base, wherein at least a portion of the base of the clip is positioned between the lug and the mount, wherein the spring clip arm is spaced from and capable of deflection toward and away from the second face of the lug;

a slot in the base of the clip; and a channel on the mount;

wherein the tang extending from the lug extends through the slot of the base of the clip and into the channel on the mount;

wherein the tang extending through the slot of the base clip and into the channel of the mount inhibits rotation of the lug and the clip relative to the mount;

the clip arm being juxtaposed to the second face of the lug and adapted to retain the end feature of the fuse therebetween and in electrical connection with the lug;

wherein the end feature is the form of a blade and the spring clip arm retains the blade against the second face of the lug with generally planar face to face contact therebetween;

wherein the conductor port is accessible to access the conductor in the lug when the end feature of the fuse is retained by the clip arm.

19. The assembly of claim 16 wherein the mounting screw is threadably mated with the mount and accessible for rotation relative to the mount when the end feature of the fuse is retained by the clip arm.

20. The assembly of claim 9 wherein the mounting screw is threadably mated with the mount and accessible for rotation relative to the mount when the power distribution component is retained by the clip arm.

21. The assembly of claim 1 wherein the clip arm has an arcuate contact surface which is bowed inwardly toward the second face of the lug.

22. The assembly of claim 12 wherein the clip arm has an arcuate contact surface which is bowed inwardly toward the second face of the lug.

23. The assembly of claim 18 wherein the clip arm has an arcuate contact surface which is bowed inwardly toward the second face of the lug.

* * * * *